United States Patent [19]

Brown

[11] Patent Number: 4,469,473

[45] Date of Patent: Sep. 4, 1984

[54] RECIPROCATING PISTON APPARATUS

[75] Inventor: Forest G. Brown, Valley Center, Kans.

[73] Assignee: Sigma Tek Inc., Wichita, Kans.

[21] Appl. No.: 354,150

[22] Filed: Mar. 5, 1982

[51] Int. Cl.[3] ..... F04B 39/10

[52] U.S. Cl. ..... 417/571; 92/140

[58] Field of Search ..... 417/567–571, 417/534; 92/138, 140; 74/45

[56] References Cited

U.S. PATENT DOCUMENTS

| | | | |
|---|---|---|---|
| 1,865,000 | 6/1932 | Goldberg | 417/571 X |
| 2,176,691 | 10/1939 | Simons | 417/571 X |
| 2,463,766 | 3/1949 | Hadley | 417/571 X |

FOREIGN PATENT DOCUMENTS

| | | | |
|---|---|---|---|
| 2558960 | 2/1977 | Fed. Rep. of Germany | 417/534 |

*Primary Examiner*—Edward K. Look

*Attorney, Agent, or Firm*—Harold E. Meier

[57] ABSTRACT

Apparatus including a reciprocating piston driven by a connecting means operating within a slider for driving a piston in a reciprocating motion. The slider is mounted in a crank case housing and includes guides for maintaining the orientation of the piston relative to surrounding cylinder walls. The cylinder is attached to the crank case housing at one end and attached to a cylinder head at the opposite end. The cylinder head includes an intake valve and an exhaust valve for controlling the flow of fluid into and from the piston chamber. To drive the piston a crank shaft is rotatably attached to a connecting means that rotates within the slider and connects thereto. Fastened to the crank shaft is a flexible coupling for coupling the crank shaft to a source of driving power.

28 Claims, 8 Drawing Figures

RECIPROCATING PISTON APPARATUS

TECHNICAL FIELD

This invention relates to reciprocating piston apparatus, and more particularly to a folded connecting rod for a oil less pump.

BACKGROUND ART

Reciprocating piston devices such as pumps, compressors, and internal combustion engines have utilized a single piece direct connecting rod, that is, a fixed length connecting rod between a crank shaft and the reciprocating piston. The result of this use of long connecting rods was a pump, compressor, or engine having an overall axial dimension sufficient to accomodate the necessary motion of the long connecting rod.

While this invention is not restricted to oil less pumps, the prior art of such pumps includes not only reciprocating pistons as described above, but also sliding vane rotary pumps. The sliding vane rotary pump, and also sliding vane rotary compressors, all require an extensive lubrication system to insure that the sliding vanes are maintained in an adequate lubrication environment. This requirement for lubricating the sliding vanes made necessary the use of complicated lubricating systems or materials having self-lubricating properties. Both solutions to the lubrication problem were costly and in addition there are difficulties in maintaining workable pumps or compressors.

While the lubrication of a reciprocating piston type pump, compressor, or other device is well understood, the size requirement necessitated by the use of a fixed length connecting rod prohibited the universal acceptance of reciprocating piston devices where size is a factor.

DISCLOSURE OF THE INVENTION

In accordance with the present invention there is provided reciprocating piston apparatus that includes a cylinder attached to a crank case. Mounted within the crank case is a slider having a piston support at one end and a skirt extending from the piston support. The skirt includes an access port and a bushing with the access port located in the skirt between the piston support and the bushing. Connected to the slider is a piston that moves in the cylinder in a reciprocating motion along with the reciprocating motion of the slider in the crank case. Rotatably mounted to the crank case is a crank shaft that extends into the slider through the access port. That part of the crank shaft that extends into the skirt is connected to a connecting rod that has a second end connected to the bushing.

In one embodiment of the invention is a reciprocating piston pump, the crank case includes a substantially rectangular internal chamber and the slider skirt has a substantially rectangular configuration that fits into the internal chamber. Attached to the sidewalls of the skirt are guides for maintaining the face of the piston in a relative position with respect to the cylinder walls.

For coupling a source of driving power to the crank shaft there is provided in one embodiment of the invention a coupling having a flexible drive axis. One part of the coupling connects to the crank shaft and the second part is attached to the source of driving power.

In accordance with the present invention as described above there is provided a reciprocating piston apparatus wherein the piston is connected to a crank shaft through a short connecting rod. The phase "short connecting rod" refers to the use of the slider skirt as one part of a connecting means coupled to the crank shaft.

BRIEF DESCRIPTION OF THE DRAWINGS

For a more complete understanding of the present invention and the advantages thereof, reference is now made to the following description taken in conjunction with the accompanying drawings.

Referring to the drawings.

DETAILED DESCRIPTION

Figure 1:
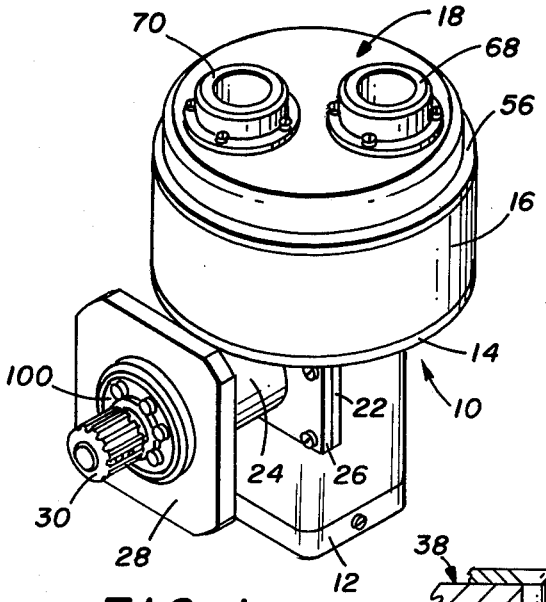
FIG. 1 is an isometric view of a oil less pump utilizing the present invention of a short connecting rod.

Referring to the FIGURES, and in particular to FIG. 1, there is shown a reciprocating piston oil less pump which may also be used as a compressor. One application of such a pump is to provide instrument vacuum or pressure in medium to lightweight aircraft. The pump to be described may also be used to provide pressure to deicing equipment. As illustrated, the pump includes a crank case housing 10 having a lower cover 12 attached by means of screws or other fastening devices. At the top of the housing 10 there is formed integral therewith a cylinder flange 14 (not shown in FIG. 1) to which is mounted a cylinder 16 having attached thereto a cylinder head 18. The cylinder head 18 includes fittings 20 as the input and output ports to the pump. Also included as a port of the cylinder head 18 is a reed plate (to be described).

Formed integral with one side of the crank case housing 10 is a mounting flange 22 to which is attached a bearing enclosure 24 having a flange 26 for attachment to the flange 22. A mounting support 28 is included as part of the bearing enclosure 24 on the end opposite the flange 26. The mounting support 28 is provided to mount the pump/compressor to a source of driving power, such as an aircraft engine of medium to small aircraft. Rotatably mounted within the bearing enclosure 24 in a manner to be described is a flexible coupling to which is attached a drive spline 30 that engages with the output gear of a driving engine.

Figure 2:
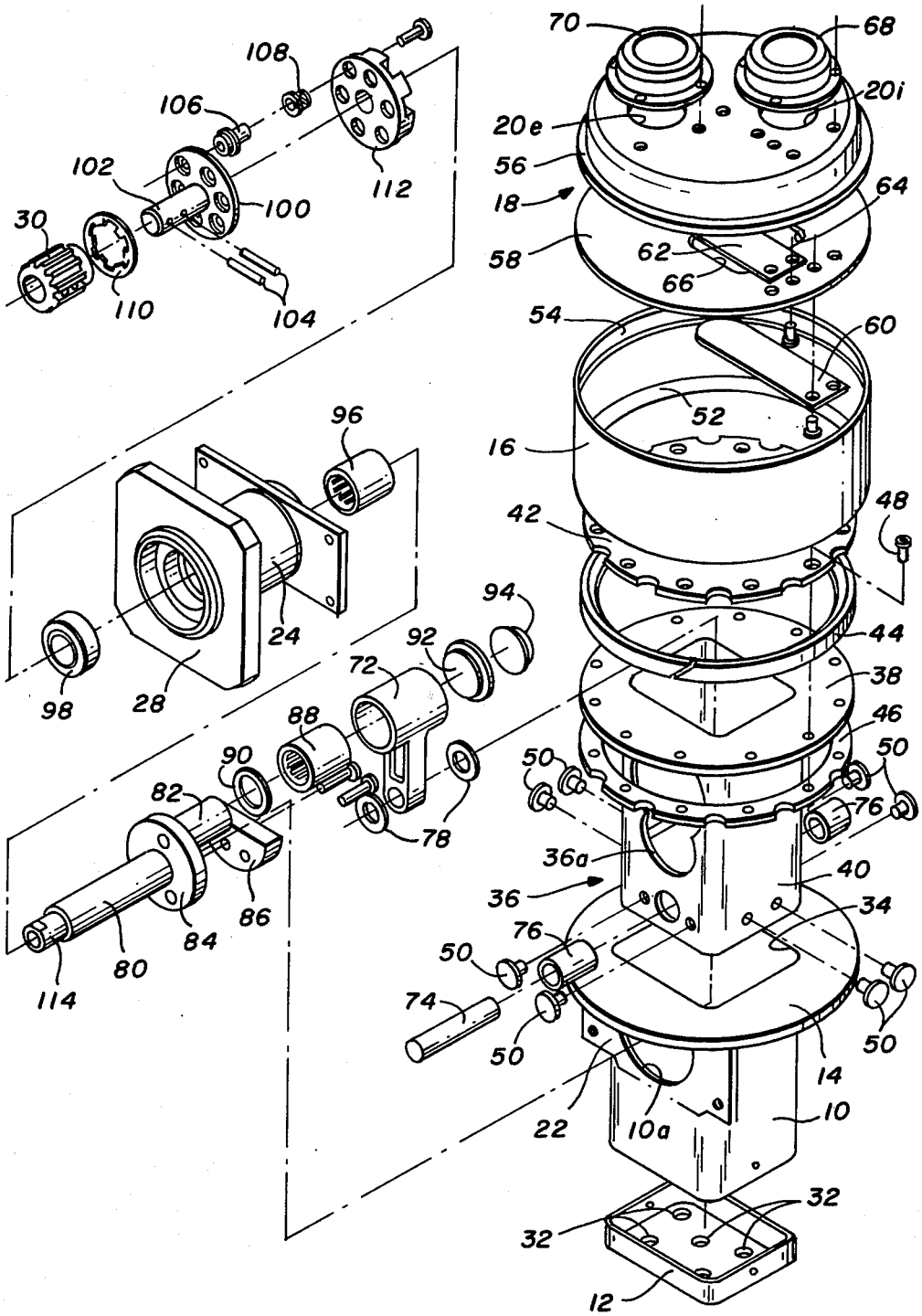
FIG. 2 is an exploded view of the oil less pump of FIG. 1 showing the various parts and their arrangement.

Referring specifically to FIG. 2, there is shown an exploded view of the pump of FIG. 1, detailing each of the parts used in the construction of such apparatus. Included within the lower cover 12 are vent openings 32 for providing ventilation of the crank case housing to minimize pressure build-up therein during operation of the pump/compressor. Slidably mounted within the crank case housing 10 in a substantially rectangular chamber 34 is a piston slider 36 also having a substantially rectangular configuration. The piston slider 36 includes a mounting flange 38 formed at the top as an integral unit with a skirt 40.

Riveted or otherwise attached to the mounting flange 38 is a piston plate 42 with a piston ring 44 assembled between the piston and the mounting flange. Completing the assembly that forms the reciprocating piston is a retaining ring 46.

Figure 3:
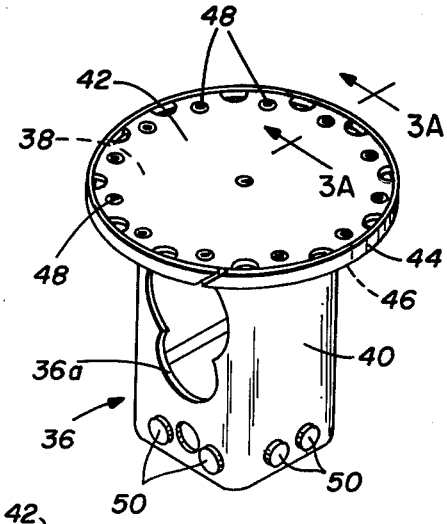
FIG. 3 is a pictorial view of the slider and piston assembly of FIG. 2.
Figure 3A:
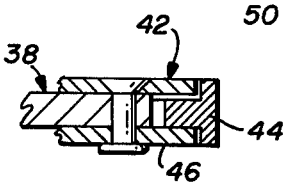
FIG. 3A is a section, partially cut away, through the piston assembly connected to the slider, taken along the line 3—3 of FIG. 3.

With reference to FIGS. 3 and 3A, there is shown the piston plate 42, the piston ring 44, the mounting flange 38 and the retaining ring 46 assembled into an operating unit by means of rivets 48. Mounted to the skirt 40 are piston positioning buttons 50 that slide against the interior walls of the chamber 34. These positioning buttons 50 along with the piston ring 44 orient the reciprocating piston relative to the walls of the cylinder 16.

Returning to FIG. 2, the interior walls of the cylinder 16 are polished in accordance with standard cylinder facing procedures. The lower portion of the cylinder 16 includes a mounting ring 52 that is dimensioned to slide over the cylinder flange 14 and may be held in place by curling the ring 52 around the edge of the flange 14. At the upper portion of the cylinder 16 is a mounting ring 54 for receiving the cylinder head 18. The cylinder head 18 is assembled to the cylinder 16 by curling the mounting ring 54 around a head flange 56.

Included as part of the cylinder head 18 is a head plate 58 that is positioned against the head flange 56 when assembled into the mounting ring 54. Attached to the head plate 58 is an intake valve 60 and an exhaust valve 62. The valves 60 and 62 are mounted to the head plate 58 over apertures 64 and 66, respectively. The valves 60 and 62 are mounted to the plate 58 by means of rivets or other fasteners.

Attached to the upper surface of the cylinder head 18 are connectors 68 and 70 positioned over the intake and exhaust ports **20*i* and 20*e***, respectively.

With the parts thus far described with reference to FIG. 2, the pump/compressor of the present invention when assembled has an outward appearance as shown in FIG. 1.

Figure 4:
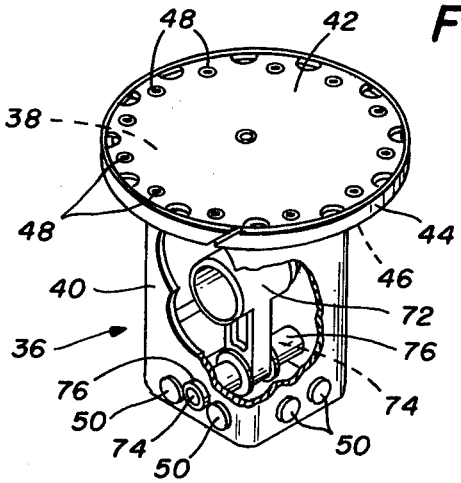
FIG. 4 is a pictorial view, partially cut away, showing the slider and connecting rod of FIG. 2 assembled into a unit.

To drive the piston in a reciprocating motion a connecting rod 72 is connected to the slider 40 by means of a connecting rod pin 74. The connecting rod pin 74 is rotatably mounted in the slider 36 by means of bushings 76. The connecting rod 72 is maintained correctly positioned on the connecting rod pin 74 by means of thrust washers 78. This assembly of the connecting rod 72 to the slider 36 is best illustrated in FIG. 4 where the slider is partially cut away to show the interconnection between the connecting rod and the connecting rod pin.

Figure 5:
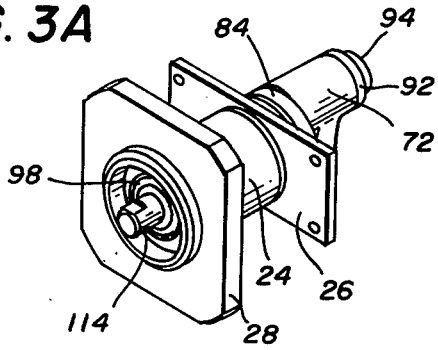
FIG. 5 is a pictorial view of the crank shaft of FIG. 2 assembled into a flange bearing enclosure.

With reference now to FIGS. 2 and 5, the connecting rod 72 is driven by a crank shaft 80 having an eccentric pin 82 extending from a flange 84. Attached to the flange 84 is a crank balancing weight 86. Rotatably mounted to the eccentric pin 82 by means of a roller bearing 88 is the connecting rod 72. The correct position of the connecting rod 72 on the eccentric pin 82 is established by a thrust washer 90. The connecting rod 72 is maintained on the eccentric pin 82 by means of a rod cap 92. Fastened to the rod cap 92 is a thrust pad 94 that establishes the position of the crank shaft 80 within the slider 36. Note, that in assembling the connecting rod 72 to the slider 36, it is first passed through an opening **10*a* of the crank case housing 10 and then through an opening 36*a* of the slider 36. Thus, the crank shaft 80 actually extends into the interior of the slider 36, thus providing a long crank arm for driving the piston 42** in a reciprocating motion.

To support the crank shaft 80 in the crank case housing 10, a roller bearing 96 is pressed into the bearing enclosure 24 next to the mounting flange 26. A bearing 98 is also press fitted to the bearing enclosure 24 at the mounting support 28. The crank shaft 80 is assembled through the bearings 96 and 98 and thus rotatably supported therein. This entire assembly, as best illustrated in FIG. 5, is attached to the crank case housing 10 by means of the mounting flange 22 and the mounting flange 26. With the parts of FIG. 2, as so far described, assembled in the proper order, there results the pump of FIG. 1 without the drive spline 30.

Figure 6:
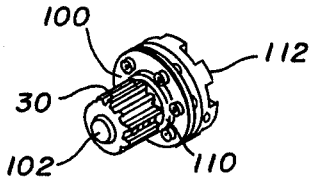
FIG. 6 is a pictorial view of the coupling of FIG. 2 assembled into an operating unit.
Figure 7:
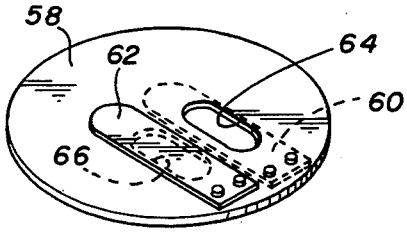
FIG. 7 is an isometric view of the head plate and valves of FIG. 2 assembled into an operating unit.

Referring now to FIGS. 2 and 6, the drive spline 30 is part of a flexible coupling including a pin flange 100 as a part of a drive shaft 102. The drive spline 30 is attached to the shaft 102 by means of roll pins 104. Assembled into each of the openings of the pin flange 100 is a coupling pin 106. For the coupling illustrated six such coupling pins 106 are provided although only one is shown for clarity. The coupling pins 106 are held in place in the pin flange 100 by means of a fastener, such as rivets.

Mating with each of the coupling pins 106 is a bushing 108 as part of an insert flange 112 forming a second element of the coupling as illustrated in FIG. 6. The insert flange 112 is attached to a shaft 114 of the connecting rod 80. The spline 30 is coupled to a source of driving power to rotate the crank shaft 80 and thereby the eccentric pin 82 within the slider 36. Rotation of the eccentric pin 82 drives the connecting rod 72 to impart reciprocating motion to the piston 42 by means of the connecting rod pin 74. The valves 60 and 62 operate to control the flow of air into and out of the piston chamber through the cylinder head chamber. The pressurized air is applied to an external system by means of the connectors 68 and 70.

With the parts of FIG. 2 assembled as described there results the reciprocating piston pump of FIG. 1. The pump has a two-piece folded connecting arm providing the advantages of a long connecting arm with a minimum space requirement.

While only one embodiment of the invention, together with modifications thereof, has been described in detail herein and shown in the accompanying drawings, it will be evident that various further modifications are possible without departing from the scope of the invention.

I claim:

1. Apparatus including a reciprocating piston, comprising:

a cylinder including cylinder head means having intake and exhaust valves;

a crank case attached to said cylinder and including crank shaft mounting means;

a slider having a piston mounting at one end and a skirt extending from the mounting, said skirt for guiding said slider within said cylinder and including an access port and a bushing, the access port positioned in the skirt between the piston mounting and the bushing, said slider mounted in said crank case for reciprocating motion therein;

a piston attached to the piston mounting in said cylinder and reciprocating with said slider;

a crank shaft rotatably mounted to the crank shaft mounting means of said crank case, said crank shaft extending into the skirt of said slider through the access port thereof; and a connecting rod contained in said skirt and having one end rotatably mounted to the crank shaft and a second end connected to said bushing, said connecting rod and said skirt forming a folded connecting means for coupling said crank shaft to said piston, thereby reducing the overall axial dimension of said apparatus.

2. Apparatus including a reciprocating piston as set forth in claim 1 including piston guide means attached to said skirt to maintain the face of said piston in a relative position with respect to the cylinder walls.

3. Apparatus including a reciprocating piston as set forth in claim 1 wherein said crank shaft mounting means includes a bearing enclosure with the crank shaft extending therethrough and supported for rotatable motion.

4. Apparatus including a reciprocating piston as set forth in claim 1 wherein said piston has an edge dimension along the longitudinal axis of said cylinder much less than the length of said skirt along said longitudinal axis.

5. Apparatus including a reciprocating piston as set forth in claim 1 wherein said crank case includes a substantially rectangular internal chamber, and said slider includes a substantially rectangular skirt which fits within the internal chamber of said crank case for reciprocating motion therein.

6. Apparatus including a reciprocating piston, comprising:

a cylinder;

a crank case attached to said cylinder;

a slider having a piston mounting at one end and a skirt extending from the mounting, said skirt for guiding said slider within said cylinder and including an access port and a bushing, the access port positioned in the skirt between the piston mounting and the bushing, said slider mounted in said crank case for reciprocating motion therein;

a piston attached to the piston mounting in said cylinder and reciprocating with said slider;

means including a rotatable crank shaft, said means connected to the crank case with the crank shaft extending into the access port of said slider; and a connecting rod contained in said skirt and having one end rotatably mounted to the crank shaft and a second end connected to said bushing, said connecting rod and said skirt forming a folded connecting means for coupling said crank shaft to said piston, thereby reducing the overall axial dimension of said apparatus.

7. Apparatus including a reciprocating piston as set forth in claim 6 wherein said cylinder includes a cylinder head having a valve chamber therein, said valve chamber including an intake valve and an exhaust valve for controlling a flow of fluid to said piston.

8. Apparatus including a reciprocating piston as set forth in claim 7 wherein said valve chamber further includes a head plate and wherein the intake and exhaust valves are mounted to the head plate.

9. Apparatus including a reciprocating piston as set forth in claim 6 wherein said slider includes means for guiding said piston in the cylinder.

10. Apparatus including a reciprocating piston as set forth in claim 6 wherein said means further includes a coupling for connecting the crank shaft to a source of driving power.

11. Apparatus including a reciprocating piston as set forth in claim 10 wherein said coupling includes a flexible link between the source of driving power and said crank shaft.

12. A reciprocating piston pump, comprising:

a cylinder;

a crank case having a substantially rectangular internal chamber and including a flange attached to said cylinder;

a cylinder head attached to said cylinder at the opposite end thereof from the flange of said crank case;

a slider having a flange at one end thereof and a substantially rectangular skirt extending from the flange, said skirt for guiding said slider within said cylinder and including an access port and a bushing, the access port positioned in the skirt between the flange and the bushing;

the substantially rectangular skirt sliding within the internal chamber of said crank case for reciprocating motion therein;

a piston including a piston ring attached to the flange of the slider in said cylinder for reciprocating motion with the slider;

a crank shaft rotatably mounted in said crank case, said crank shaft extending into the skirt of said slider through the access port; and a connecting rod contained in said skirt and having one end rotatably mounted to the crank shaft and a second end connected to said bushing, said connecting rod and said skirt forming a folded connecting means for coupling said crank shaft to said piston, thereby reducing the overall axial dimension of the pump.

13. A reciprocating piston pump as set forth in claim 12 including piston guide means in each side of said skirt to maintain the face of said piston in a relative position with respect to the cylinder walls.

14. A reciprocating piston pump as set forth in claim 13 wherein said crank case includes a bearing enclosure with the crank shaft extending therethrough and supported for rotatable motion.

15. A reciprocating piston pump as set forth in claim 12 wherein said cylinder head includes a valve chamber having intake valves and exhaust valves for controlling flow into and from said piston.

16. A reciprocating piston pump as set forth in claim 12 wherein said piston and piston ring have an edge dimension along the longitudinal axis of said cylinder much less than the length of the skirt of said slider along the longitudinal axis.

17. An aircraft pump, comprising:

a cylinder including a cylinder head defining a valve chamber with intake and exhaust valves for controlling air into and out of said cylinder;

a crank case attached to said cylinder and having an opening through one side thereof;

a slider having a flange at one end and a skirt extending from the flange, said skirt for guiding said slider within said cylinder and including an access port and a bushing, the access port positioned in the skirt between the flange and the bushing;

said slider mounted in said crank case with the access port and the opening of said crank case in position to be aligned, said slider having a reciprocating motion in said crank case;

a piston attached to the flange of said slider in said cylinder and reciprocating with the slider;

a crank shaft rotatably mounted in said crank case, said crank shaft extending through the opening of said crank case and extending into the skirt of said slider through the access port;

a connecting rod contained in said skirt and having one end rotatably mounted to the crank shaft and a second end connected to said bushing, said connecting rod and said skirt forming a folded connecting means for coupling said crank shaft to said piston, thereby reducing the overall axial dimension of said pump; and a bearing enclosure attached to said crank case with the crank shaft extending therethrough and supported for rotatable motion.

18. An aircraft pump as set forth in claim 17 including a coupling attached to the crank shaft for providing the rotary motion thereto from a source of driving power.

19. An aircraft pump as set forth in claim 18 wherein said coupling includes a flexible link between the source of driving power and said crank shaft.

20. An aircraft pump as set forth in claim 17 wherein said valve chamber includes a head plate and the intake and exhaust valves are mounted to the head plate.

21. Apparatus including a reciprocating piston, comprising:

a cylinder;

a crank case having an internal chamber and attached to said cylinder;

connecting means in the internal chamber, said connecting means having a first arm with a piston mounting at one end and a bushing at the opposite end, said first arm for guiding said connecting means within said cylinder, and a second arm contained in said first arm mounted at one end to the bushing and having a second end positioned between the piston mounting and the bushing of said first arm;

a piston including a piston ring attached to the piston mounting of the connecting means for reciprocating motion in said cylinder; and a crank shaft rotatably mounted in said crank case, said crank shaft connected to the second arm of said connecting means.

22. Apparatus including a reciprocating piston as set forth in claim 21 wherein the first arm of said connecting means includes an opening for receiving the second arm, and wherein said crank shaft connects to the second arm in said opening.

23. Apparatus including a reciprocating piston as set forth in claim 21 including piston guide means attached to said connecting means to maintain the face of said piston in a fixed relative position with respect to the cylinder walls.

24. Apparatus including a reciprocating piston as set forth in claim 21 wherein said cylinder includes a cylinder head having a valve chamber therein, said valve chamber including an intake valve and an exhaust valve for controlling a flow of fluid to said piston.

25. Apparatus including a reciprocating piston as set forth in claim 21 including a coupling attached to the crank shaft for providing rotary motion thereto from a source of driving power.

26. Apparatus including a reciprocating piston as set forth in claim 25 wherein said coupling includes a flexible link between the source of driving power and said crank shaft.

27. Apparatus including a reciprocating piston, comprising:

a cylinder;

a crank case attached to said cylinder and including crank shaft mounting means;

a slider having a piston mounting at one end and a skirt extending from the mounting, said skirt for guiding said slider within said cylinder and including an access port and a bushing, the access port positioned in the skirt between the piston mounting and the bushing, said slider mounted in said crank case for reciprocating motion therein;

a piston attached to the piston mounting in said cylinder and reciprocating with said slider;

a crank shaft rotatably mounted to the crank shaft mounting means of said crank case, said crank shaft extending into the skirt of said slider through the access port thereof;

a connecting rod contained in said skirt and having one end rotatably mounted to the crank shaft and a second end connected to said bushing, said connecting rod and said skirt forming a folded connecting means for coupling said crank shaft to said piston; and piston guide means attached to said skirt to maintain the face of said piston in a relative position with respect to the cylinder walls.

28. Apparatus including a reciprocating piston, comprising:

a cylinder;

a crank case attached to said cylinder;

a slider having a piston mounting at one end and a skirt extending from the mounting, said skirt for guiding said slider within said cylinder and including an access port and a bushing, the access port positioned in the skirt between the piston mounting and the bushing, said slider mounted in said crank case for reciprocating motion therein;

a piston attached to the piston mounting in said cylinder and reciprocating with said slider;

means including a rotatable crank shaft, said means connected to the crank case with the crank shaft extending into the access port of said slider;

a connecting rod contained in said skirt and having one end rotatably mounted to the crank shaft and a second end connected to said bushing, said connecting rod and said skirt forming a folded connecting means for coupling said crank shaft to said piston; and a coupling for connecting the crank shaft to a source of driving power, said coupling including a flexible link between the source of driving power and said crank shaft.

* * * * *